US011474446B2

(12) United States Patent
Hong et al.

(10) Patent No.: US 11,474,446 B2
(45) Date of Patent: Oct. 18, 2022

(54) IDENTIFYING OCCURRENCE OF BACKGROUND BASED ON AN IMAGE DENSITY

(71) Applicant: Hewlett-Packard Development Company, L.P., Spring, TX (US)

(72) Inventors: Jinman Hong, Pangyo (KR); Jaebeom Yoo, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/296,341

(22) PCT Filed: Feb. 13, 2020

(86) PCT No.: PCT/US2020/018135
§ 371 (c)(1),
(2) Date: May 24, 2021

(87) PCT Pub. No.: WO2020/190433
PCT Pub. Date: Sep. 24, 2020

(65) Prior Publication Data

US 2022/0100115 A1 Mar. 31, 2022

(30) Foreign Application Priority Data

Mar. 15, 2019 (KR) ..... 10-2019-0029942

(51) Int. Cl.
*G03G 15/02* (2006.01)
*G03G 15/00* (2006.01)

(52) U.S. Cl.
CPC ..... *G03G 15/0283* (2013.01); *G03G 15/0266* (2013.01); *G03G 15/5041* (2013.01); *G03G 15/5058* (2013.01)

(58) Field of Classification Search
USPC ..... 399/89
See application file for complete search history.

(56) References Cited

U.S. PATENT DOCUMENTS 5,805,956 A * 9/1998 Kawai ..... G03G 15/5037 399/48
6,501,917 B1 12/2002 Karasawa
(Continued)

FOREIGN PATENT DOCUMENTS

JP 4052841 B2 2/2008
JP 2009122338 6/2009
(Continued)

*Primary Examiner* — Quana Grainger
(74) *Attorney, Agent, or Firm* — Trop Pruner & Hu, P.C.

(57) ABSTRACT

An image forming apparatus includes a print engine including a photosensitive drum forming an image on an image forming medium, a charging member charging the photosensitive drum, a power supply to provide a charging power supply having a reference charging voltage to the charging member, a sensor to detect an image density of an image formed on the image forming medium, and a processor to control the power supply to change a magnitude of voltage of the charging power supply within a predetermined voltage range at predetermined periods, and to identify an occurrence of a background with respect to the photosensitive drum based on an image density detected by the sensor while the charging power supply is changed.

18 Claims, 6 Drawing Sheets

(56) References Cited

U.S. PATENT DOCUMENTS

| | | | | |
|---|---|---|---|---|
| 7,395,002 | B2 | 7/2008 | Funayama et al. | |
| 8,682,183 | B2 | 3/2014 | Tanaka | |
| 2009/0202260 | A1* | 8/2009 | Morikuni | G03G 15/065 399/48 |
| 2016/0349658 | A1* | 12/2016 | Izumi | G03G 15/5058 |
| 2017/0351192 | A1 | 12/2017 | Ikada et al. | |

FOREIGN PATENT DOCUMENTS

| | | |
|---|---|---|
| JP | 2016218119 | 12/2016 |
| JP | 2016218120 | 12/2016 |
| JP | 2017219832 | 12/2017 |

* cited by examiner

IDENTIFYING OCCURRENCE OF BACKGROUND BASED ON AN IMAGE DENSITY

BACKGROUND

An image forming apparatus is an apparatus which generates, prints, acquires and transmits image data. Representative examples thereof may include a printer, a scanner, a copy machine, a facsimile, and a multifunction peripheral (MFP) in which some or all of the functions of the above-described devices are combined.

In recent years, a laser printing type image forming apparatus is mainly used. A printing operation of the laser printing type image forming apparatus is divided into charge, exposure, development, transferring and fusing.

BRIEF DESCRIPTION OF THE DRAWINGS

The same reference numerals are used to represent the same elements throughout the drawings.

DETAILED DESCRIPTION

Examples will be described below in greater detail with reference to the accompanying drawings. The examples described below may be modified and implemented in various different forms.

Meanwhile, in the disclosure, a case in which any one feature is connected with the other feature includes a case in which the features are directly connected with each other and a case in which the parts are electrically connected with each other with other features interposed therebetween. Further, it should be understood that the term "includes" means that other constituent elements may be further included rather than excluding the other constituent elements unless specially mentioned on the contrary.

As used herein, the term "image forming job" may mean various jobs associated with an image (e.g., printing, scanning or faxing), such as forming an image or generating, storing or transferring an image file. The term "job" may include an image forming job as well as a series of processes for performing an image forming job.

Further, the term "image forming apparatus" may mean a device that prints print data that is generated from a terminal, such as a computer, on a recording paper. Examples of such an image forming apparatus may include a copier, a printer, a facsimile, and a Multi-Function Peripheral (MFP) that has multiple functions of the above-described apparatuses in one unit.

Further, the term "print data" may mean data that is converted into a printable format in a printer. On the other hand, if the printer supports direct printing, the file itself may become the print data.

Figure 1:
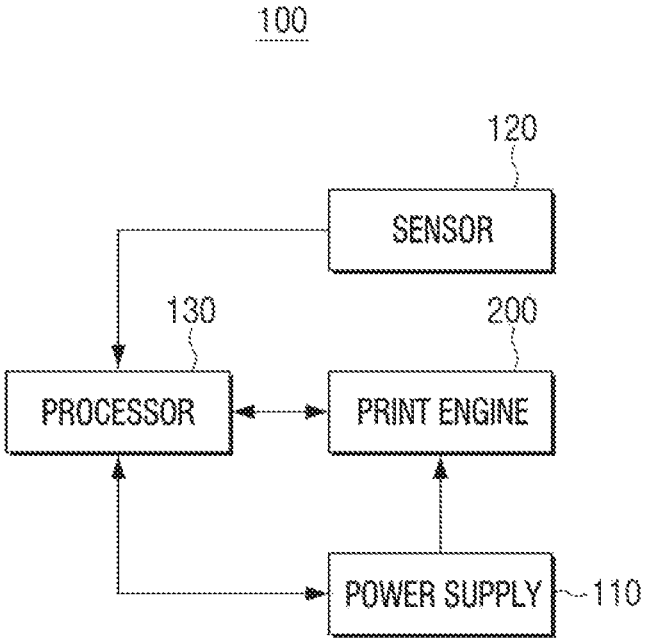
FIG. 1 is a block diagram illustrating a brief configuration of an image forming apparatus, according to an example of the disclosure.

FIG. 1 is a block diagram illustrating a configuration of an image forming apparatus, according to an example of the disclosure.

Referring to FIG. 1, an image forming apparatus 100 may include a print engine 200, a power supply 110, a sensor 120, and a processor 130.

The print engine 200 may form an image. For example, the print engine 200 may form an image on a printing paper by using a photosensitive drum and a charging member charging the photosensitive drum. An example composition and operation of the photosensitive drum and the charging member will be described below by referring to FIG. 3.

Further, the print engine 200 may form a predetermined mark on an image forming medium. Here, the predetermined mark may be used to indicate an area for readily identifying a period in which a charging power fluctuates. The detailed shape of the predetermined mark will be described later with reference to FIG. 5. Further, the image forming medium is a medium on which an image is formed, which may be an intermediate transfer belt, a transfer belt and the like.

The power supply 110 may provide a charging power to a charging member. For example, the power supply 110 may provide a predetermined reference charging voltage to the charging member in a printing operation, and when a background detection is performed, change a voltage magnitude of the charging power within a predetermined voltage range in units of a predetermined period and provide the charged power with the changed voltage magnitude to the charging member. Here, the changed charging power may have a form of a square wave, a sine wave, a triangle wave, a pulse wave and the like.

Further, the predetermined voltage range is a voltage range indicating from a maximum charging voltage to a minimum charging voltage. The maximum charging voltage may be a voltage value which is a predetermined magnitude larger than a reference charging voltage, and the minimum charging voltage may be a voltage value which is a predetermined magnitude less than the reference charging voltage.

In the example described above, it is described that the maximum charging voltage and the minimum charging voltage are different from the reference charging voltage value by the same period. However, in actual implementation, they may be different from the reference charging voltage value by different periods.

Further, the predetermined period may be defined as a time period from a minimum charging voltage of the charging power to the minimum charging voltage again, a time period from a maximum charging voltage to the maximum charging voltage again, or a time period from a specific voltage to the specific voltage again through the minimum (or maximum) to maximum (minimum) charging voltage. This predetermined period may have a value of several ms to several hundred ms.

Meanwhile, when the image forming apparatus 100 is capable of performing color printing and includes a plurality of photosensitive drums and a plurality of charging members, the power supply 110 may sequentially change a charging potential supplied to any one charging member while providing a reference charging potential corresponding to each of the plurality of charging members to the respective charging members. For example, a charging power supply to the K charging member may be changed for a predetermined time, thereafter, a charging power supply to the C charging member may be changed, and a charging power supply may be changed in an order of the M charging member and the Y charging member.

Meanwhile, in actual implementation, a charging power supply provided to a plurality of charging members may be simultaneously changed. In this case, the power supply 110 may control the periods of variable charging power supplies to be different from each other.

The sensor 120 may detect an image density of an image formed on an image forming medium. For example, the sensor 120 may identify a predetermined mark formed on the image forming medium, and after the predetermined mark is identified, detect an image density. In this case, the sensor 120 may adjust an amount of light for easily detecting the image density. For example, accordingly, the sensor 120 may maintain the amount of light when an image density of a K photosensitive drum is detected, and significantly increase a light emission amount when image densities of C, M and Y photosensitive drums are detected.

Further, the sensor 120 may adjust a light receiving method to easily detect the image density. For example, the sensor 120 may be implemented as an image density (ID) sensor (or concentration sensor) for detecting concentration or a color registration sensor for color registration.

This sensor 120 may include a light emitter, a first light receiver to receive a regular reflected wave regularly reflected from the image forming medium, and a second light receiver to receive an irregular reflected wave irregularly reflected from the image forming medium.

In this case, the sensor 120 may identify the occurrence of a background with respect to a black photosensitive drum by using the regular reflected wave regularly reflected from the image forming medium, that is, a value detected in the first light receiver, and identify the occurrence of the background with respect to a cyan photosensitive drum, a magenta photosensitive drum and a yellow photosensitive drum by using an irregular reflected wave irregularly reflected from the image forming medium, that is, a value detected in the second light receiver.

The processor 130 may control each element within the image forming apparatus 100. The processor 130 may be configured as one apparatus such as a central processing unit (CPU), and may also be configured as a plurality of apparatuses such as a clock generation circuit, a CPU, and a graphic processor.

The processor 130 may, when a print data is received from a print control terminal (not illustrated), generate a print image by performing rendering through parsing of the received print data, etc.

In addition, the processor 130 may control the print engine 200 so that the generated print image is printed. In this case, the processor 130 may control the power supply 110 so that a charging voltage within a voltage range in which a background to be described later is not detected is supplied to a charging member, and control the print engine 200 so that a printing operation is performed while this charging voltage is supplied.

Further, the processor 130 may, when it is necessary to detect a background, control the power supply 110 so that a changed charging power supply is provided to the charging member. If the image forming apparatus 100 is capable of color printing and includes a plurality of photosensitive drums and a plurality of charging members, the processor 130 may, while a charging power of a reference charging voltage corresponding to a charging member is supplied to each of the plurality of charging members, control the power supply 110 so that a charging power supply to the respective charging members is sequentially changed.

Further, the processor 130 may identify the occurrence of background for a photosensitive drum based on an image density detected by the sensor 120 while the charging power supply is changed. Further, the processor 130 may identify the occurrence of the background for a photosensitive drum based on an image density detected by the sensor 120 while the charging power supply is changed.

For example, when a variation period of charging power supply is 50 ms (that is, 20 Hz), it may be determined whether a background is present based on whether a 20 Hz component for the detected image density is greater than or equal to a predetermined value.

When an occurrence of background is not identified, the processor 130 may reduce a reference charging voltage for a current charging member by a predetermined magnitude and further identify whether a background is detected, and perform this operation repeatedly so that a voltage range in which a background for the current charging member may be thereby identified.

For example, when a background has not occurred, when the operation is repeated, the same offset may be applied to a previous charging voltage, a maximum charging voltage and a minimum charging voltage and a repeated operation may be performed. For example, when a background is identified using a charging voltage in the range of 1390 V to 1410 V, an additional background identification may be performed using a charging voltage in the range of 1380 V to 1400 V to which a 10 V voltage offset is applied.

Meanwhile, in actual implementation, an offset value other than 10 V may be applied, and an offset value may be converted by stages.

When it is identified that a background has not occurred, as the operation is repeated, a repeated operation may be performed by applying an offset to a minimum charging voltage without changing a charging voltage and a maximum charging voltage. For example, when a background is identified using a charging voltage in the range of 1390 V to 1410 V, in the process thereafter, an additional background identification may be performed using a charging voltage in the range of 1380 V to 1410V.

In contrast, when it is identified that a background has occurred, the processor 130 may increase a charging voltage for a current charging member by a predetermined magnitude, and identify a charging potential at which a background is not detected.

If a charging potential at which an occurrence of background is not identified is found, the processor 130 may change a potential value for the corresponding charging member to a potential value at which a background is not identified.

On the other hand, although a configuration that constitutes the image forming apparatus has been illustrated and described, various configurations may be additionally provided during implementation. This will be explained below by referring to FIG. 2.

Figure 2:
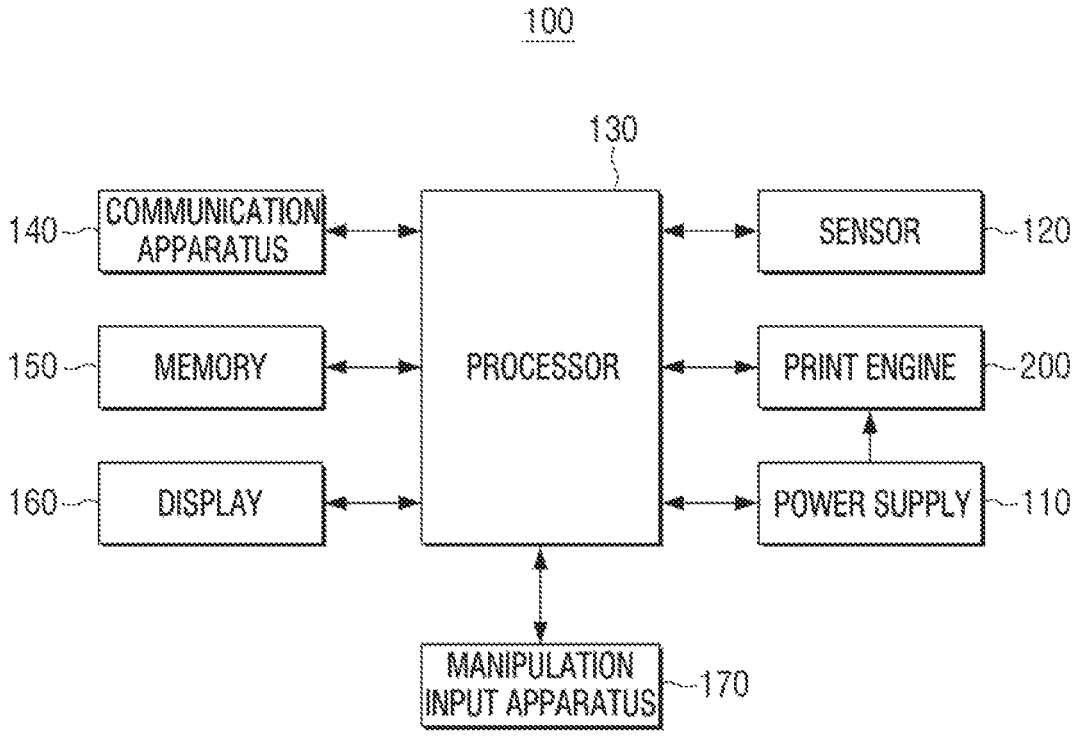
FIG. 2 is a block diagram illustrating a configuration of an image forming apparatus, according to an example of the disclosure.

FIG. 2 is a block diagram illustrating a brief configuration of an image forming apparatus, according to an example of the disclosure.

Referring to FIG. 2, the image forming apparatus 100 may include a power supply 110, a sensor 120, a processor 130, a communication apparatus 140, a memory 150, a display 160, a manipulation input apparatus 170 and a print engine 200.

Operations of the power supply 110, the sensor 120 and the print engine 200 are explained with reference to FIG. 1, and thus a repeated explanation is omitted. In addition, the processor 130 is explained with reference to FIG. 1, and thus will not be further explained below for the sake of brevity. Added elements in FIG. 2 are explained below.

The communication apparatus 140 may be connected to a print control terminal (not illustrated), and receive print data from the print control terminal. The print control terminal may be an electronic apparatus providing print data, which may be, for example, a personal computer (PC), a notebook PC, a tablet PC, a smartphone, a server and the like.

The communication apparatus 140 may be formed to connect the image forming apparatus 100 to an external apparatus, and may be connected via a local area network (LAN) or the Internet as well as a universal serial bus (USB) port or a wireless communication (e.g., Wi-Fi 802.11a/b/g/n, near field communication (NFC), or Bluetooth) port. The communication apparatus 140 may be referred to as a transceiver.

The memory 150 may store print data. For example, the memory 150 may store print data received from the communication apparatus 140 described above, and store a rendering image for the received print data. The memory 150 may be implemented to be an external storage medium, a removable disk that includes a Universal Serial Bus (USB) memory, and/or a web server through a network as well as a storage medium within the image forming apparatus 100.

Further, the memory 150 may store a pattern image corresponding to a predetermined mark. Further, the memory 150 may store a charging potential magnitude (or a voltage range in which a background is not detected) set for the current charging member.

The display 160 may display various information provided from the image forming apparatus 100. For example, the display 160 may display a user interface window for selecting various functions provided in the image forming apparatus 100. For example, the user interface window may include an area for receiving input of execution of a function of detecting a background, a function of finding a charging potential where no background occurs, etc.

The manipulation input apparatus 170 may receive, from the user, input of a function selection and a control command for the corresponding function. In an example, the function may include printing, copying, scanning, and fax transmission. The function control command as described above may be input through a control menu that is displayed on the display 160.

The manipulation input apparatus 170 may be implemented by a plurality of buttons, a keyboard, and a mouse, and may also be implemented by a touch screen that can simultaneously perform the function of the display 160.

The processor 130 may, when a voltage range where no background is detected is identified, store the identified voltage range in the memory 150. Further, during a print job, the processor 130 may control the power supply 110 so that a charging potential within the voltage range stored in the memory is provided to the charging member.

As described above, the image forming apparatus 100 according to an example of the disclosure may identify whether a background occurs in a current state, and a charging voltage margin until a background occurs.

Accordingly, the image forming apparatus 100 may identify the occurrence of background and a charging voltage margin and thereby, it is possible to prevent degradation of image quality caused when a background occurs. Further, it is possible to perform a print job by reducing an unwanted consumption of toner amount caused by the background.

Figure 3:
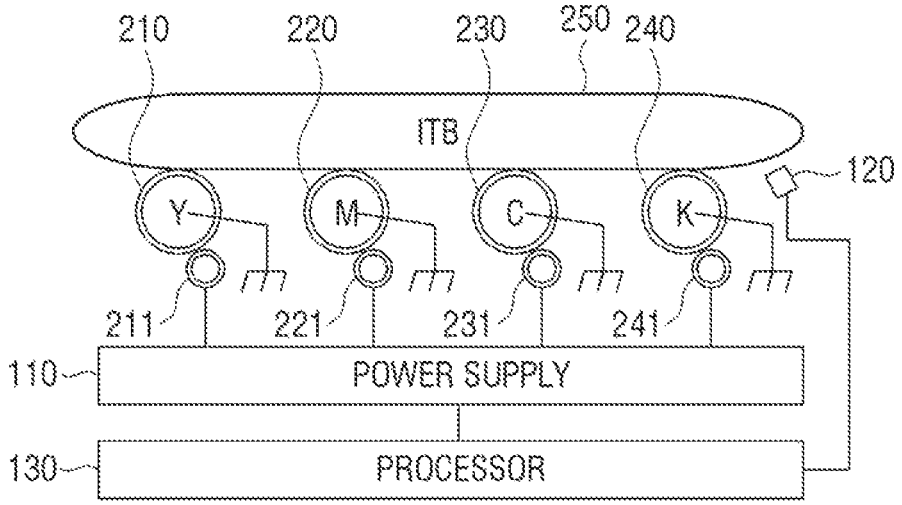
FIG. 3 is a diagram illustrating an example of a detailed configuration of a print engine of FIG. 1.

FIG. 3 is a diagram illustrating an example of a detailed configuration of a print engine of FIG. 1.

Referring to FIG. 3, the print engine 200 may be operated using a tandem method. The tandem method is a color printing method in which a photosensitive drum for each color individually performs an image forming job for high-speed output.

An electrostatic latent image is formed in the photosensitive drums 210, 220, 230 and 240. The photosensitive drums 210, 220, 230 and 240 may be referred to as an optical photo conductor (OPC), a photosensitive body, a photosensitive belt and the like, according to forms. In an example, a first photosensitive drum 210 may be a yellow photosensitive drum forming yellow color, a second photosensitive drum 220 may be a magenta photosensitive drum forming magenta color, a third photosensitive drum 230 may be a cyan photosensitive drum forming cyan color, and a fourth photosensitive drum 240 may be a black photosensitive drum forming black color.

The charging members 211, 221, 231 and 241 may charge each of surfaces of the photosensitive drums 210, 220, 230 and 240 to a uniform potential. The charging members 211, 221, 231 and 241 may be implemented as a corona charging members 211, 221, 231 and 241, a charging roller, a charging brush and the like.

Exposure equipment (not illustrated) may form an electrostatic latent image on the surface of the photosensitive drums 210, 220, 230 and 240 through changing of the surface potential of the photosensitive drums 210, 220, 230 and 240 according to image information to be printed. A developer (not illustrated) may accommodate a developing agent therein, and develop the electrostatic latent image into a visible image through supply of the developing agent onto the electrostatic latent image.

The visible image formed on the photosensitive drums 210, 220, 230 and 240 may be transferred to the intermediate transfer belt 250. Further, the image transferred to the intermediate transfer belt 250 may be transferred to a printing paper by a transferring apparatus.

Further, the image may be fused on the printing paper by a fuser (not illustrated). By this series of processes, the print job may be completed.

A background phenomenon and a background detection method according to an example of the disclosure will be described below with reference to a configuration of FIG. 3.

In an electrophotographic method, as described above with reference to FIG. 3, a toner is charged in the developer by a potential difference of an image area formed through exposure of the developer and the photosensitive drum.

A toner should not be attached to a non-image area other than an exposure area of a photosensitive drum. If a toner is attached to a non-image area, unwanted toner consumption occurs. As described above, a phenomenon in which a toner is attached to a non-image area is referred to as a background.

This background is associated with a voltage difference between a developer voltage and a surface potential of a photosensitive drum and a charge amount of a toner. When the toner charging amount is the same, the background may increase with the decrease in difference between the developer voltage and the surface potential of the photosensitive drum, and decrease with the increase in difference between the developer voltage and the surface potential of the photosensitive drum.

Accordingly, it may be considered to significantly increase a potential difference between the developer and the photosensitive drum to reduce background. However, while a two-component toner is used, when a difference of potential is significantly increased, there is an issue that a carrier is transferred to the photosensitive drum, and thus it is possible to increase a difference of potential within a limited range.

Accordingly, it is necessary to identify a low voltage range in which no background occurs, but in related art, it is difficult to identify whether or not a background is present in a current state (in a set charging potential).

For example, in view of the fact that noise is present due to the characteristics of an intermediate transfer belt and a sensor, the presence of background may be identified when a change of value over the noise is detected, and because a relative comparison is possible, it is impossible to identify whether or not a background is present in an initial state.

Further, in a color image forming apparatus, all colors are delivered to the intermediate transfer belt and thus, it is impossible to distinguish colors even when the occurrence of background is detected.

Accordingly, in this disclosure, a charging power supply is changed so that a potential difference is generated at predetermined periods and accordingly, it is identified whether or not a background is present through confirmation of whether a change in image density is present. The operation described above will be described below with reference to FIG. 4.

Further, when a plurality of photosensitive drums are included, the image forming apparatus 100 may identify in which photosensitive drum a background occurs by sequentially changing a magnitude of charging potential of a charging member corresponding to each of the plurality of photosensitive drums. In this case, the image forming apparatus 100 may perform a detecting operation in the order of colors (that is, K, C, M and Y) closer to the sensor 120 so that a background detection time may be reduced.

Further, to more precisely identify a change of background, colors may be distinguished when an image density of measured, and a light emission amount corresponding to a color currently identified and a light receiver may be adjusted and thereby, a sensing resolution may be increased.

Figure 4:
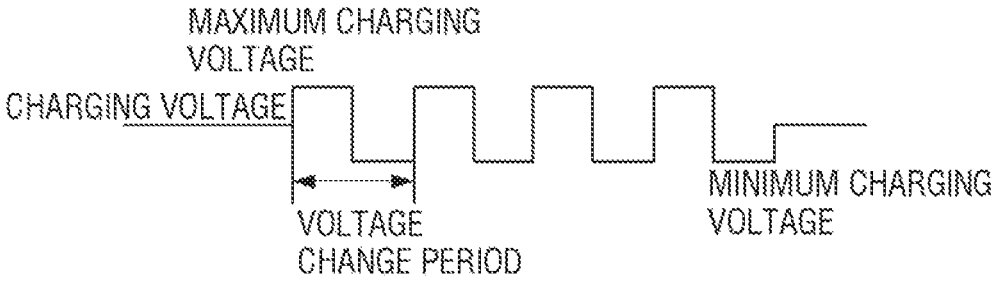
FIG. 4 is a diagram illustrating a charging voltage generated according to an example of the disclosure.

FIG. 4 is a diagram illustrating a charging voltage generated according to an example of the disclosure.

Referring to FIG. 4, a changing charging power supply may have the shape of a square wave. In the example illustrated, a square wave is used. However, in actual implementation, a value may be periodically changed based on a reference charging voltage, and thus a sine wave, a triangle wave, a pulse wave, etc. may be used other than the square wave.

Further, in the example described above, a DC component (that is, magnitude) of a charging power supply is changed. However, in actual implementation, a changing charging power supply may be generated using the DC component and an AC component in combination. For example, an AC power supply in the form of a square wave, a sine wave, a triangle wave and a pulse wave and a DC power supply provided to a charging member may be overlapped with each other when a change of charging power supply is necessary, and thereby a changing charging power supply as illustrated in FIG. 4 may be generated.

Hereinafter, for convenience of explanation, it will be assumed that a charging voltage as illustrated in FIG. 4 is provided to the K photosensitive drum.

A surface potential of the K photosensitive drum 240 may be determined by a current flowing through the charging member 241 in contact with the K photosensitive drum. For example, when the charging voltage of the K photosensitive drum is determined as 1400 V, the power supply 110 may provide, to the K charging member 241, a charging voltage having a maximum charging voltage of 1410 V, a minimum charging voltage of 1390 V and a period of 50 ms.

Meanwhile, in an example, a difference value, period, and number of repetitions of a charging voltage may be variously modified.

In the example described above, a minimum charging voltage and a maximum charging voltage are changed alternately and periodically. However, the charging voltage described above may be expressed as the sum of a direct current voltage and an alternating current voltage.

For example, a charging voltage as in FIG. 4 may be referred to as the sum of a direct current voltage of 1400 V and a pulse alternating current voltage of 20 Vpp.

A case where a background occurs while this charging power supply is provided will be described below with reference to FIG. 5.

Figure 5:
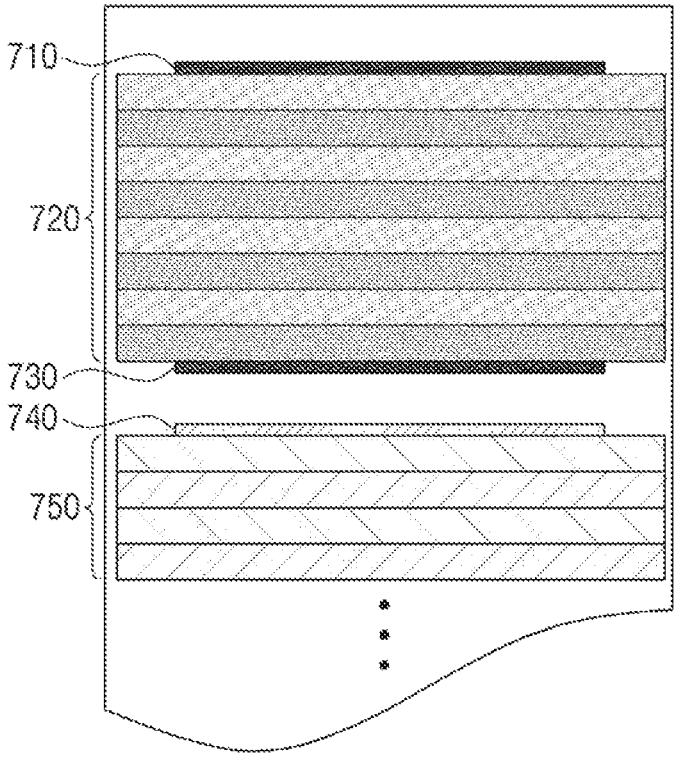
FIG. 5 is a diagram illustrating a charging voltage generated according to an example of the disclosure.

FIG. 5 is a diagram illustrating a charging voltage generated according to an example of the disclosure.

Referring to FIG. 5, a predetermined mark (or an exposure image band) 710 and 730 may be formed at a starting part and end part of a time point when a charging potential is changed for each photosensitive member. For example, to detect a background for K, a first mark 710 may be formed, a charging power supply for the K charging member may be changed, after the charging power supply is changed, a second mark 730 may be formed, and to detect a background for C, and a third mark 740 may be formed and an operation of changing a charging power supply for the C charging member may be repeatedly performed. Meanwhile, in actual implementation, the operation of forming a predetermined mark may be omitted.

Meanwhile, when a charging power supply is changed as in FIG. 4 and a voltage range of the changed charging power supply is in a range where a background occurs, an image with an image density difference 720 and 750 as illustrated in FIG. 5 may be formed on an intermediate transfer belt.

That is, in an environment where a background occurs, when a charging voltage is changed, a difference of concentration is increased with the increase in background, and a difference of concentration is decreased with the decrease in background.

Meanwhile, when an image as illustrated in FIG. 5 is formed, a frequency analysis may be performed using a Fourier Transform from a value of a specific point at a value sensed by the sensor 120. When a frequency component (for example, 20 Hz) corresponding to a predetermined period (for example 5 ms) of a changing charging power supply is detected high upon the frequency analysis, it may be determined that a background occurs in a current charging potential range.

Even when a background is not present, a 20 Hz component may be detected as a high value depending on the frequency analysis. In this case, a phase may be calculated together and it may be identified whether the corresponding component is resulted from a predetermined mark (that is, an exposure image band).

Figure 6:
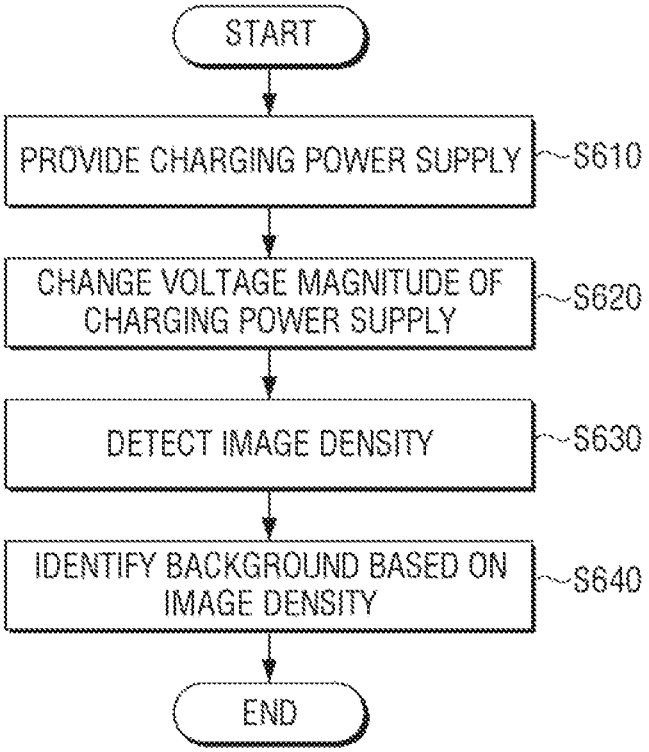
FIG. 6 is a flowchart provided to explain a charge control method, according to an example of the disclosure.

FIG. 6 is a flowchart provided to explain a charge control method, according to an example of the disclosure.

Referring to FIG. 6, a charging power supply may be provided to a charging member charging a photosensitive drum, at operation S610. When the image forming apparatus 100 includes a plurality of photosensitive drums, a charging power supply corresponding to each of the photosensitive drums may be individually provided to the respective photosensitive drums.

Further, a magnitude of voltage of a charging power supply may be changed within a predetermined voltage range at predetermined periods, at operation S620. When the image forming apparatus 100 includes a plurality of photosensitive drums, a charging power supply provided to each of a plurality of charging members corresponding to each of the plurality of charging drums may be sequentially provided to the respective charging members. In this case, the charging power supply may be changed in an order closest to the sensor. For example, the charging power supply may be changed in the order of K, C, M and Y charging members.

Further, an image density of an image formed on an image forming medium may be detected at operation S630. The image density may be detected using an image density (ID) sensor. When a background for the K photosensitive drum is detected, a light of a normal light emission amount may be radiated to the image forming medium to detect the image density, and when a background for the C, M and Y photosensitive drums other than the K photosensitive drum is detected, a light emission amount may be significantly increased and a sensing resolution may be increased and the image density may be detected.

Further, when a background for the K photosensitive drum is detected, the image density may be detected using a regular reflected wave regularly reflected from the image forming medium, and when the occurrence of background for a cyan photosensitive drum, a magenta photosensitive drum and a yellow photosensitive drum is identified, the image density may be detected using an irregular reflected wave irregularly reflected from the image forming medium.

Further, the occurrence of background for a photosensitive drum may be identified based on an image density detected while a charging power supply is changed, at operation S640. For example, a frequency analysis for the detected image density may be performed, and the occurrence of background for the photosensitive drum may be identified based on a frequency component of an image density corresponding to a predetermined period of the changed charging power supply.

When no background is identified, a predetermined voltage range may be changed by stages and a voltage range where no background occurs may be identified.

In contrast, when a background is identified, a reference charging voltage may be increased so that no background occurs or that a background is reduced.

As described above, the charging control method according to an example of the disclosure may identify whether a background occurs in a current state, and a charging voltage margin until a background occurs. Accordingly, the occurrence of background and a charging voltage margin may be identified and thereby, it is possible to prevent degradation of image quality caused when a background occurs. Further, it is possible to perform a print job by reducing an unwanted consumption of toner amount caused by the background.

The charging control method described above may be implemented as a program and provided to an image forming apparatus. For example, the program including a charging control method according to examples disclosed herein may be stored in a non-transitory computer readable medium and provided therein. In an example, the non-transitory computer readable medium may be a compact disc (CD), digital video disc (DVD), hard disk drive (HDD), solid state drive (SSD), Blu-ray disc, universal serial bus (USB), memory card, read-only memory (ROM), or the like.

The foregoing examples and advantages are merely examples and are not to be construed as limiting the disclosure. The examples disclosed herein can be readily applied to other types of apparatuses. Also, the description of the examples of the disclosure is intended to be illustrative, and not to limit the scope of the claims, and many modifications and variations may be applied to the examples.

What is claimed is:

1. An image forming apparatus, comprising:

a print engine including:

a photosensitive drum to form an image on an image forming medium, and a charging member to charge the photosensitive drum;

a charging power supply to provide a reference charging voltage to the charging member;

a sensor to detect an image density of the image formed on the image forming medium by the photosensitive drum; and a processor to:

control the charging power supply to change a magnitude of a voltage of the charging power supply within a predetermined voltage range at predetermined periods, perform a frequency analysis of the image density detected using the sensor, and identify an occurrence of a background with respect to the photosensitive drum based on the image density detected using the sensor while the magnitude of the voltage of the charging power supply is changed, wherein the identifying of the occurrence of the background with respect to the photosensitive drum is based on a frequency component of the image density corresponding to a predetermined period among the predetermined periods.

2. The image forming apparatus as claimed in of claim 1, wherein the processor is to increase the reference charging voltage from the charging power supply by a predetermined magnitude in response to identifying the occurrence of the background.

3. The image forming apparatus of claim 1, wherein the processor is to:

change the predetermined voltage range and identify a voltage range in which no background is detected, and based on print data received by the image forming apparatus, control the charging power supply to provide a voltage within the identified voltage range to the charging member.

4. The image forming apparatus of claim 1, wherein the processor is to:

control the charging power supply to reduce the reference charging voltage in response to not identifying the background.

5. The image forming apparatus of claim 1, wherein the processor is to:

control the print engine to form a predetermined mark on the image forming medium, and control the charging power supply to change the magnitude of the voltage of the charging power supply after the predetermined mark is generated.

6. The image forming apparatus of claim 1, wherein:

the print engine includes a plurality of photosensitive drums, and a plurality of charging members to charge respective photosensitive drums of the plurality of photosensitive drums, and the charging power supply is to provide charging power to each of the plurality of charging members.

7. The image forming apparatus as claimed in of claim 6, wherein the processor is to control the charging power supply to sequentially change the charging power to the plurality of charging members, and identify an occurrence of a background with respect to each of the plurality of photosensitive drums.

8. The image forming apparatus of claim 6, wherein:

the plurality of photosensitive drums include a black photosensitive drum, a cyan photosensitive drum, a magenta photosensitive drum, and a yellow photosensitive drum, and the processor is to:

control the sensor to detect the image density using a regular reflected wave regularly reflected from the image forming medium when an occurrence of a background with respect to the black photosensitive drum is identified, and control the sensor to detect the image density using an irregular reflected wave irregularly reflected from the image forming medium when an occurrence of a background with respect to the cyan photosensitive drum, the magenta photosensitive drum, or the yellow photosensitive drum is identified.

9. The image forming apparatus of claim 1, wherein the charging power supply is to output a waveform in a shape of one of a square wave, a sine wave, a triangle wave, or a pulse wave.

10. A method comprising:

providing, by a charging power supply, a reference charging voltage to a charging member charging a photosensitive drum provided to form an image on an image forming medium;

changing a magnitude of a voltage of the charging power supply within a predetermined voltage range at predetermined periods;

detecting, using a sensor, an image density of the image formed on the image forming medium;

performing, by a processor, a frequency analysis of the image density detected using the sensor; and identifying, by the processor, an occurrence of a background with respect to the photosensitive drum based on the image density detected using the sensor while the magnitude of the voltage of the charging power supply is changed, wherein the identifying of the occurrence of the background with respect to the photosensitive drum is based on a frequency component of the image density corresponding to a predetermined period among the predetermined periods.

11. The method of claim 10, comprising:

increasing a magnitude of the reference charging voltage from the charging power supply in response to identifying the occurrence of the background.

12. The method of claim 10, wherein the identifying comprises:

changing the predetermined voltage range in stages and identifying a voltage range in which no background is detected, the method further comprising:

based on print data received by the image forming apparatus, controlling the charging power supply to provide a voltage within the identified voltage range to the charging member, and performing a print job with respect to the print data received by the image forming apparatus.

13. The method of claim 10, comprising controlling the charging power supply to reduce the reference charging voltage in response to not identifying the background.

14. The method of claim 10, wherein the image forming apparatus includes a plurality of photosensitive drums, and a plurality of charging members charging respective photosensitive drums of the plurality of photosensitive drums, the method comprising:

sequentially changing charging power provided by the charging power supply to the plurality of charging members; and identifying an occurrence of a background with respect to each of the plurality of photosensitive drums.

15. A non-transitory machine-readable storage medium comprising instructions that upon execution cause an image forming apparatus:

control a charging power supply to provide a reference charging voltage to a charging member charging a photosensitive drum provided to form an image on an image forming medium;

change a magnitude of a voltage of the charging power supply within a predetermined voltage range at predetermined periods;

detect, using a sensor, an image density of the image formed on the image forming medium;

identify an occurrence of a background with respect to the photosensitive drum based on the image density detected using the sensor while the magnitude of the voltage of the charging power supply is changed;

change the predetermined voltage range in stages and identify a voltage range in which no background is detected; and based on a print data received by the image forming apparatus, control the charging power supply to provide a voltage within the identified voltage range to the charging member.

16. The non-transitory machine-readable storage medium of claim 15, wherein the instructions upon execution cause the image forming apparatus to:

perform a frequency analysis of the image density detected using the sensor; and wherein the identifying of the occurrence of the background with respect to the photosensitive drum is based on a frequency component of the image density corresponding to a predetermined period among the predetermined periods.

17. The non-transitory machine-readable storage medium of claim 15, wherein the instructions upon execution cause the image forming apparatus to:

increase the reference charging voltage from the charging power supply in response to identifying the occurrence of the background.

18. The non-transitory machine-readable storage medium of claim 15, wherein the charging power supply is to output a waveform in a shape of one of a square wave, a sine wave, a triangle wave, or a pulse wave.

* * * * *